US010309292B2

(12) United States Patent
Nagai et al.

(10) Patent No.: US 10,309,292 B2
(45) Date of Patent: Jun. 4, 2019

(54) COOLANT CIRCULATION SYSTEM FOR VEHICLE-MOUNTED INTERNAL COMBUSTION ENGINE

(71) Applicant: TOYOTA JIDOSHA KABUSHIKI KAISHA, Toyota-shi, Aichi-ken (JP)

(72) Inventors: Atsushi Nagai, Toyota (JP); Kohichiroh Yonemura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/857,110

(22) Filed: Dec. 28, 2017

(65) Prior Publication Data

US 2018/0252146 A1 Sep. 6, 2018

(30) Foreign Application Priority Data

Mar. 2, 2017 (JP) ..... 2017-039418

(51) Int. Cl.

| | |
|---|---|
| ***F01P 7/10*** | (2006.01) |
| ***F01P 3/02*** | (2006.01) |
| ***F01P 7/16*** | (2006.01) |
| ***F01P 5/12*** | (2006.01) |

(52) U.S. Cl.

CPC ..... *F01P 7/162* (2013.01); *F01P 3/02* (2013.01); *F01P 5/12* (2013.01); *F01P 2005/125* (2013.01); *F01P 2025/08* (2013.01); *F01P 2025/64* (2013.01); *F01P 2037/02* (2013.01)

(58) Field of Classification Search

CPC .... F01P 2037/02; F01P 7/164; F01P 2031/30; F01P 5/12; F01P 7/162; F01P 5/10

See application file for complete search history.

(56) References Cited

U.S. PATENT DOCUMENTS

2002/0005178 A1* 1/2002 Iwatani ..... F01M 5/021 123/41.14
2009/0314847 A1* 12/2009 Nemoto ..... B60H 1/00764 237/5
2011/0126784 A1* 6/2011 Kobayashi ..... F01M 1/16 123/41.02

(Continued)

FOREIGN PATENT DOCUMENTS

JP H08-14043 A 1/1996
JP 2008-169750 A 7/2008
WO 2011/021511 A1 2/2011

*Primary Examiner* — Long T Tran

(74) *Attorney, Agent, or Firm* — Oliff PLC

(57) ABSTRACT

A coolant circulation system includes a coolant circuit including a water jacket, a motor-driven pump, an outlet liquid temperature sensor, and a controller. The controller executes variation determination control for driving the motor-driven pump to determine whether a variation in the temperature of the coolant in a diesel engine is equal to or less than a predetermined value based on an outlet temperature detected by the outlet liquid temperature sensor. The controller executes circulation stop control on condition that it is determined that the variation in the temperature of the coolant is equal to or less than the predetermined value. The controller changes the period during which the circulation stop control is executed in accordance with the outlet liquid temperature detected at the start of the circulation stop control.

8 Claims, 4 Drawing Sheets

(56) References Cited

U.S. PATENT DOCUMENTS

| | | | | |
|---|---|---|---|---|
| 2011/0246007 | A1* | 10/2011 | Choi | B60H 1/00885<br>701/22 |
| 2012/0132154 | A1* | 5/2012 | Suzuki | F01P 7/164<br>123/41.02 |

* cited by examiner

COOLANT CIRCULATION SYSTEM FOR VEHICLE-MOUNTED INTERNAL COMBUSTION ENGINE

BACKGROUND OF THE INVENTION

The present invention relates to a coolant circulation system for a vehicle-mounted internal combustion engine.

Japanese Laid-Open Patent Publication No. 2008-169750 discloses a coolant circulation system that executes circulation stop control for stopping circulation of the coolant after the internal combustion engine starts up, for the purpose of promoting the warm-up of the internal combustion engine. This coolant circulation system changes the period during which the circulation stop control is executed in accordance with the temperature of the coolant detected at the start of the circulation stop control. Specifically, the lower the temperature of the coolant at the start of the circulation stop control, the greater becomes a determination value for terminating the circulation stop control. In addition, the circulation stop control is terminated based on the fact that the time during which the circulation stop control is executed or an accumulated air amount during the circulation stop control has reached a determination value.

The lower the temperature of the coolant at the start of the circulation stop control is, the longer becomes the time required for completing the warm-up. For this reason, the coolant circulation system sets a termination condition such that the lower the temperature of the coolant at the start of the circulation stop control is, the longer becomes the period during which the circulation stop control is executed.

An internal combustion engine is provided with a liquid temperature sensor for detecting the temperature of the coolant is provided. As described above, if the period during which the circulation stop control is executed is changed in accordance with the temperature of the coolant at the start of the circulation stop control, the coolant may boil in the part of the internal combustion engine with a higher temperature of the coolant than that in the vicinity of the liquid temperature sensor. Consequently, while the circulation stop control is executed in accordance with the temperature of the coolant at the start of the circulation stop control, the temperature of the coolant may reach the boiling point in the part of the internal combustion engine with a higher temperature of the coolant than that in the vicinity of the liquid temperature sensor.

For example, to prevent the coolant from boiling even when the temperature of the coolant in the internal combustion engine is not uniform, the determination value may be reduced. In this case, the circulation stop control terminates at a lower temperature. However, in such a case, the circulation stop control may be terminated before the warm-up is performed sufficiently. This may reduce, the effect of promoting the warm-up by the circulation stop control.

SUMMARY OF THE INVENTION

An objective of the present invention is to provide a coolant circulation system for a vehicle-mounted internal combustion engine that prevents boiling of coolant and at the same time effectively promote the warm-up.

To achieve the foregoing objective and in accordance with a first aspect of the present invention, a coolant circulation system for a vehicle-mounted internal combustion engine is provided. The system includes a coolant circuit including a water jacket of an internal combustion engine, a motor-driven pump, which is provided in a middle of the coolant circuit and moves coolant in the coolant circuit, a liquid temperature sensor, which detects a temperature of the coolant flowing in the coolant circuit, and a controller, which controls the motor-driven pump. The controller executes circulation stop control in which the motor-driven pump is not driven so that circulation of the coolant is kept stopped after the internal combustion engine starts up. The controller changes a period during which the circulation stop control is executed in accordance with a temperature the coolant detected by the liquid temperature sensor at the start of the circulation stop control. The controller executes variation determination control in which the motor-driven pump is driven during a predetermined period after the internal combustion engine starts up to move the coolant in the coolant circuit, thereby determining whether a variation in a temperature of the coolant in the internal combustion engine is equal to or less than a predetermined value based on the temperature of the coolant detected by the liquid temperature sensor. The controller executes the circulation stop control on condition that it is determined in the variation determination control that the variation in the temperature of the coolant is equal to or less than the predetermined value.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A coolant circulation system for a vehicle-mounted internal combustion engine according to one embodiment is described below with reference to FIGS. 1 to 5.

Figure 1:
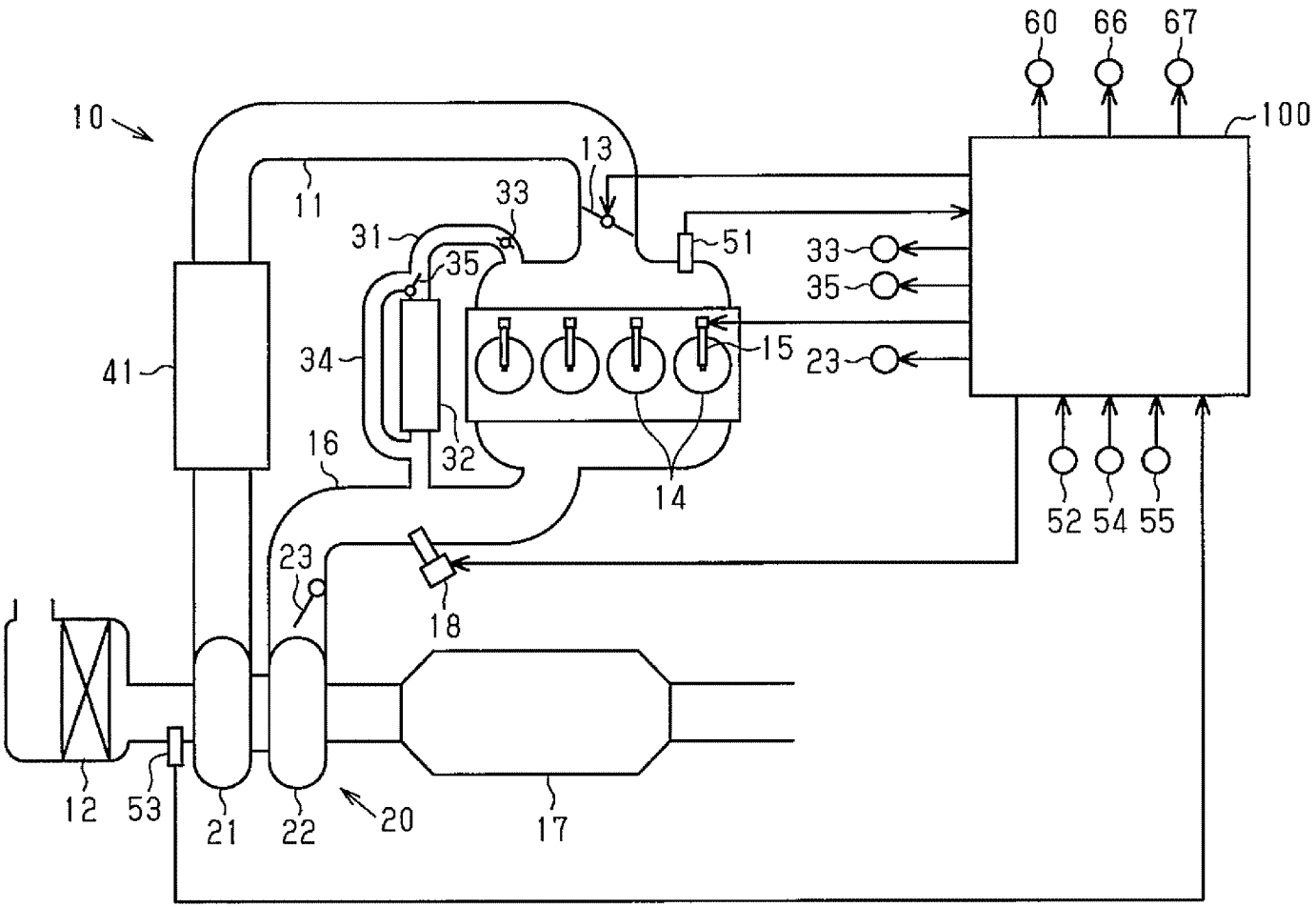
FIG. 1 is a schematic diagram illustrating the configuration of a diesel engine to which a coolant circulation system for a vehicle-mounted internal combustion engine is applied.

The configuration of a diesel engine 10, which is a vehicle-mounted internal combustion engine having the coolant circulation system incorporated therein, is described first with reference to FIG. 1.

As shown in FIG. 1, a turbocharger 20 is incorporated in the diesel engine 10. The diesel engine 10 includes an intake passage 11, in which an air cleaner 12, a compressor 21, an intercooler 41, and an intake throttle valve 13 are disposed in this order from the upstream side. The air cleaner 12 filters air taken into the intake passage 11. The compressor 21 includes a compressor wheel therein. The compressor 21 compresses air by rotation of the compressor wheel to feed the compressed air to the downstream side. The intercooler 41 cools the air compressed by the compressor 21. The intake throttle valve 13 changes the valve opening degree to adjust the flow rate of air flowing in the intake passage 11, that is, an intake air amount.

A combustion chamber 14 is constituted by each cylinder of the diesel engine 10. The part of the intake passage 11 on the downstream side of the intake throttle valve 13 is connected via an intake port to each of the combustion chambers 14. A fuel injection valve 15 is disposed in each combustion chamber 14. Air-fuel mixture of intake air from the intake passage 11 and fuel injected from the fuel injection valve 15 is burned in the combustion chamber 14.

The diesel engine 10 includes an exhaust passage 16, in which a turbine 22 and an exhaust air cleaner 17 are disposed in this order from the upstream side. Exhaust air generated by the combustion of the air-fuel mixture in the combustion chamber 14 is guided via the exhaust port to the exhaust passage 16 and then discharged to the outside. The turbine 22 includes therein a turbine wheel that is coupled to the compressor wheel by a shaft to be integrally rotational. The turbine 22 and the compressor 21 constitute the turbocharger 20. The exhaust air cleaner 17 collects particulates in the exhaust air, thus purifying the exhaust air. A fuel addition valve 18 is provided in the part of the exhaust passage 16 upstream from the turbine 22. The fuel addition valve 18 adds fuel to the exhaust air discharged from the combustion chamber 14.

When the turbine wheel is rotated by the flow of exhaust air in the turbocharger 20, the compressor wheel is also rotated in cooperation with the rotation of the turbine wheel. Compressed air is thus fed into the combustion chamber 14, that is, forced-induction is performed. That is, the turbocharger 20 drives the turbine wheel by the flow of the exhaust air to force intake air into the diesel engine 10. The turbine 22 includes an exhaust blow port that allows for passage of exhaust air blowing against the turbine wheel and a variable nozzle 23 at the exhaust blow port. As the opening degree of the variable nozzle 23 is changed, the opening area of the exhaust blow port is also changed. That is, as the opening degree of the variable nozzle 23 is adjusted, the flow of the exhaust air blowing against the turbine wheel, the pressure of forced intake air, or the forced-induction pressure is also adjusted.

In addition, the diesel engine 10 includes an exhaust gas recirculation (EGR) passage (hereinafter, referred to as an EGR passage 31). The EGR passage 31 enables the part of the exhaust passage 16 upstream from the turbine 22 to communicate with the part of the intake passage 11 downstream from the intake throttle valve 13. An EGR cooler 32 and an EGR valve 33 are disposed in the EGR passage 31. The EGR cooler 32 cools exhaust air that passes through the EGR passage 31 to be recirculated in intake air. As the opening degree of the EGR valve 33 is changed, the amount of the exhaust air recirculated in the intake air is adjusted. A bypass passage 34, which bypasses the EGR cooler 32 to allow the exhaust air to flow therein, is connected to the EGR passage 31. An EGR switching valve 35, which opens or closes the outlet of the bypass passage 34, is provided in the part of the EGR passage 31 on the downstream side of the EGR cooler 32. When the EGR switching valve 35 closes the outlet of the bypass passage 34, exhaust air passes through the EGR cooler 32 and is cooled therein, and then recirculated in the intake air. On the other hand, when the EGR switching valve 35 does not close the outlet of the bypass passage 34, exhaust air passes through not the EGR cooler 32 but the bypass passage 34 and then is recirculated in the intake air. In this case, the exhaust air is recirculated in the intake air without being cooled in the EGR cooler 32.

The diesel engine 10 is controlled by a controller 100. Detection signals of various sensors provided in respective parts of the diesel engine 10 are input to the controller 100. The sensors include an intake air pressure sensor 51, a crank position sensor 52, an airflow meter 53, an outlet liquid temperature sensor 54, and a vehicle speed sensor 55. The intake air pressure sensor 51 detects a forced-induction pressure Pim, which is the pressure of intake air in the part of the intake passage 11 downstream from the intake throttle valve 13. The crank position sensor 52 detects an engine rotational speed NE, which is the rotational speed of the crankshaft functioning as the output shaft of the diesel engine 10. The airflow meter 53 detects an outside air temperature tha, which is the temperature of intake air in the part of the intake passage 11 upstream from the compressor 21, and an intake air amount GA. The outlet liquid temperature sensor 54 is a liquid temperature sensor that detects the temperature of the coolant in the coolant circulation system. The outlet liquid temperature sensor 54 detects an outlet liquid temperature ethwout, which is the temperature of the coolant at the outlet of the diesel engine 10. The vehicle speed sensor 55 detects a vehicle speed SPD, which is the speed of the vehicle having the diesel engine 10 incorporated therein.

Next, the coolant circulation system for the diesel engine 10 is described with reference to FIG. 2.

Figure 2:
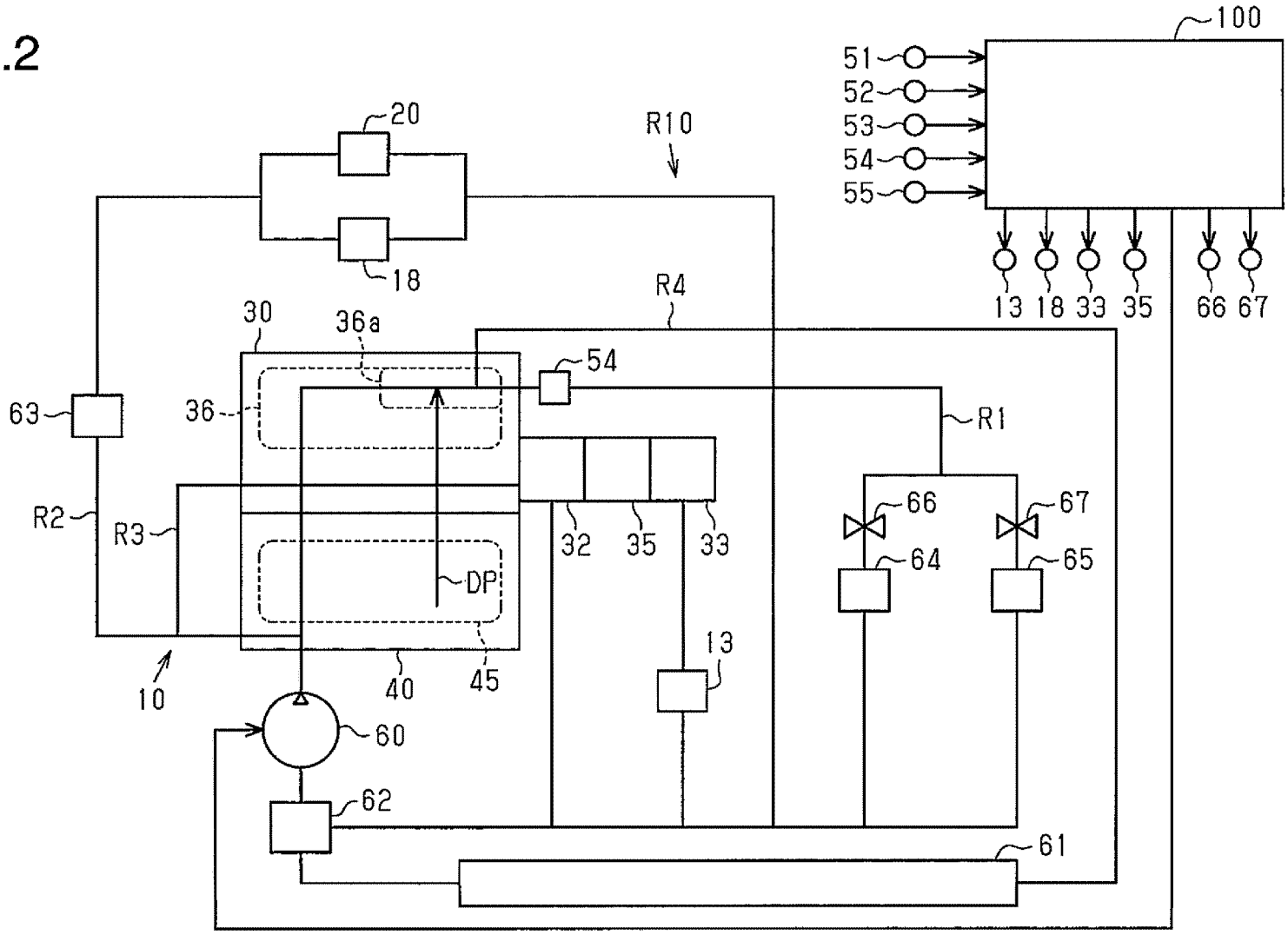
FIG. 2 is a schematic diagram illustrating a coolant circulation system for a vehicle-mounted internal combustion engine according to one embodiment.

As shown in FIG. 2, the coolant circulation system includes a coolant circuit R10 including water jackets 36 and 45 of the diesel engine 10. A motor-driven pump 60 is provided in the middle of the coolant circuit R10. The motor-driven pump 60 pumps the coolant into the coolant circuit R10 to move the coolant in the coolant circuit R10. The coolant circuit R10 includes four passages, that is, a first circulation path R1, a second circulation path R2, a third circulation path R3, and a fourth circulation path R4.

The first circulation path R1 includes the block-side water jacket 45 and the head-side water jacket 36. The block-side water jacket 45 is provided in a cylinder block 40 of the diesel engine 10, whereas the head-side water jacket 36 is provided in a cylinder head 30 of the diesel engine 10. An exhaust air cooling portion 36*a* of the head-side water jacket 36 cools the exhaust port.

The coolant ejected from the motor-driven pump 60 is first introduced into the block-side water jacket 45, passes through the block-side water jacket 45, and then flows into the head-side water jacket 36. The space between adjacent cylinders in the cylinder block 40 is referred to as an inter-bore region. A drill path DP that connects the block-side water jacket 45 to the head-side water jacket 36 is provided in the inter-bore region. Some of the coolant introduced in the block-side water jacket 45 is guided through the drill path DP to the head-side water jacket 36.

The coolant having passed through the head-side water jacket 36 is guided from the outlet of the cylinder head 30 through pipes to an air conditioner heater 64 and an ATF warmer 65, which warms up the automatic transmission fluid functioning as the operating oil of the automatic transmission. The outlet is provided at the exhaust air cooling portion 36*a* of the head-side water jacket 36. The coolant having passed through the water jackets 45 and 36 of the diesel engine 10 is guided from the outlet through pipes to the heater 64 and the ATF warmer 65.

The outlet liquid temperature sensor 54 is provided near the outlet of the exhaust air cooling portion 36*a* in the first circulation path R1. The outlet liquid temperature sensor 54 detects the outlet liquid temperature ethwout, which is the temperature of the coolant flowing from the exhaust air cooling portion 36*a* through the outlet.

The coolant having passed through the heater 64 and the ATF warmer 65 passes through a thermostat 62 and then returns to the intake port of the motor-driven pump 60. As described above, the first circulation path R1 is configured such that the coolant passes through the water jackets 45 and 36, and the heater 64 and the ATF warmer 65, and then returns to the motor-driven pump 60. A first shut-off valve 66 is provided immediately before the heater 64 in the first circulation path R1. A second shut-off valve 67 is provided immediately before the ATF warmer 65 in the first circulation path R1. Introduction of the coolant into the heater 64 and the ATF warmer 65 is shut off as needed.

The second circulation path R2 branches from the first circulation path R1 at the part of the cylinder block 40 upstream from the block-side water jacket 45. The second circulation path R2 is for guiding the coolant to an oil cooler 63, which cools the lubricant of the diesel engine 10. The coolant having passed through the oil cooler 63 is guided through pipes to the turbocharger 20 and the fuel addition valve 18. The coolant having passed through the turbocharger 20 and the fuel addition valve 18 is introduced into the part of the first circulation path R1 downstream from the heater 64 and the ATF warmer 65 and upstream from the thermostat 62. The coolant then returns to the intake port of the motor-driven pump 60. As described above, the second circulation path R2 is configured such that the coolant passes through the oil cooler 63, and the turbocharger 20 and the fuel addition valve 18, and then returns to the motor-driven pump 60.

The third circulation path R3 branches from the second circulation path R2 at the part of the second circulation path R2 downstream from the cylinder block 40 and upstream from the oil cooler 63. The third circulation path R3 is for guiding the coolant to the EGR cooler 32, the EGR switching valve 35, and the EGR valve 33. The coolant having passed through the EGR cooler 32 reaches the EGR valve 33 via the EGR switching valve 35. The coolant having passed through the EGR valve 33 is guided through pipes to the intake throttle valve 13. The coolant having passed through the intake throttle valve 13 is introduced into the part of the first circulation path R1 downstream from the heater 64 and the ATF warmer 65 and then returns to the intake port of the motor-driven pump 60. Some of the coolant introduced into the EGR cooler 32 is introduced through pipes into the part of the first circulation path R1 downstream from the heater 64 and the ATF warmer 65 and upstream from the thermostat 62. The coolant then returns to the intake port of the motor-driven pump 60. As described above, the third circulation path R3 is for circulating the coolant through the EGR cooler 32, the EGR switching valve 35, the EGR valve 33, and the intake throttle valve 13.

The fourth circulation path R4 branches from the first circulation path R1 at the exhaust air cooling portion 36*a*. The fourth circulation path R4 is for guiding the coolant to a radiator 61. The coolant having passed through the radiator 61 passes through the thermostat 62 and returns to the motor-driven pump 60. A path from the radiator 61 to the motor-driven pump 60 is opened or closed by the thermostat 62. That is, when the engine is cold in which the temperature of the coolant flowing in the first to third circulation paths and then passing through the thermostat 62 is lower than the valve opening temperature of the thermostat 62, the fourth circulation path R4 is closed by the thermostat 62. In this case, the coolant is not circulated in the fourth circulation path R4 and the radiator 61 does not radiate heat. The warm-up of the diesel engine 10 is thus promoted. On the other hand, when the temperature of the coolant is increased and the temperature of the coolant flowing in the first to third circulation paths and then passing through the thermostat 62 is equal to or higher than the valve opening temperature of the thermostat 62, the thermostat 62 is opened. Some of the coolant having passed through the water jackets 45 and 36 then flows in the fourth circulation path R4 and circulates through the radiator 61. The heat of the coolant that has passed through the water jackets 45 and 36 and thus has a high temperature is radiated by the radiator 61 and overheating of the diesel engine 10 is prevented.

The controller 100 also executes such control of the coolant circulation system. That is, the controller 100 also functions as the controller in the coolant circulation system. For example, the controller 100 opens or closes the first shut-off valve 66 and the second shut-off valve 67 based on the outlet liquid temperature ethwout detected by the outlet liquid temperature sensor 54. In addition, the controller 100 controls the motor-driven pump 60, thus controlling the circulation amount of the coolant.

Next, the control of the coolant circulation system executed by the controller 100, in particular, control of the motor-driven pump 60 is described.

When the diesel engine 10 has been warmed up, the controller 100 controls the outlet liquid temperature ethwout detected by the outlet liquid temperature sensor 54 to be close to a target temperature. At this time, the controller 100 executes outlet liquid temperature feedback control for feedback-controlling the drive duty cycle of the motor-driven pump 60 in accordance with the outlet liquid temperature ethwout. That is, the controller 100 feedback-controls the drive amount of the motor-driven pump 60 per unit time. The target temperature is higher than the valve opening temperature of the thermostat 62 and lower than the boiling point of the coolant.

When the outlet liquid temperature ethwout at the time of the start-up of the internal combustion engine is equal to or lower than a threshold $\alpha$, the controller 100 basically executes circulation stop control, in which the motor-driven pump 60 is not driven and circulation of the coolant is kept stopped. The threshold $\alpha$ is set to be slightly lower than the valve opening temperature of the thermostat 62. That is, the controller 100 executes the circulation stop control at the time of cold-start, in which the diesel engine 10 has not been warmed up. With the circulation stop control, the temperature of the coolant in the diesel engine 10 is easily increased according to an operation of the engine and thus the warm-up of the diesel engine 10 is promoted.

During the circulation stop control, the coolant is hardly moved in the coolant circuit R10, and thus it is impossible to check the progress of the warm-up by the outlet liquid temperature sensor 54. Thus, the controller 100 estimates the temperature of the coolant in the exhaust air cooling portion 36*a* during the circulation stop control. The controller 100 determines whether the warm-up is completed based on an estimated liquid temperature ethwest, which is the estimated temperature, and terminates the circulation stop control.

The controller 100 calculates the estimated liquid temperature ethwest by setting the initial liquid temperature to the outlet liquid temperature ethwout at the start of the circulation stop control. When the controller 100 calculates the estimated liquid temperature ethwest, the controller 100 adds the temperature increase per unit time to the previous estimated liquid temperature ethwest at a predetermined calculation cycle, thus updating the estimated liquid temperature ethwest. In this coolant circulation system, the temperature of the coolant in the exhaust air cooling portion 36*a* is calculated as the estimated liquid temperature ethwest. This is because in the diesel engine 10, the temperature of the exhaust air cooling portion 36*a* in particular tends to be increased during the operation of the engine. This is for preventing local boiling of the coolant during the circulation stop control.

Specifically, the controller 100 calculates a temperature change of the coolant by heat reception per unit time by using the engine rotational speed NE, a fuel injection amount Q, the forced-induction pressure Pim, and an EGR rate. The engine rotational speed NE is correlated with the number of times combustion occurs per unit time. The fuel injection amount Q is correlated with the amount of heat generated in the single occurrence of combustion. The forced-induction pressure Pim and the EGR rate are indexes that show the state of the combustion chamber 14 at the time of combustion. Thus, by using the engine rotational speed NE, the fuel injection amount Q, the forced-induction pressure Pim, and the EGR rate, it is possible to estimate the amount of heat received per unit time. The controller 100 obtains these values and calculates the temperature change of the coolant by heat reception. The forced-induction pressure Pim is an index of the heat capacity of gas in the combustion chamber 14. The EGR rate is an index of the specific heat of gas in the combustion chamber 14.

In addition, the controller 100 calculates a temperature change of the coolant by heat radiation per unit time based on the difference obtained by subtracting the outside air temperature tha from the estimated liquid temperature ethwest and the vehicle speed SPD. The higher the vehicle speed SPD is, the greater becomes the amount of outside air exposed to the diesel engine 10 per unit time. The amount of heat radiated to the outside air is thus increased. Moreover, the lower the outside air temperature tha is, the greater the amount of heat radiated becomes. The amount of heat radiated per unit time can be estimated by using the vehicle speed SPD and the outside air temperature tha and performing calculation based on the difference obtained by subtracting the outside air temperature tha from the estimated liquid temperature ethwest and the vehicle speed SPD. Thus, the controller 100 obtains the vehicle speed SPD and the outside air temperature tha and calculates the temperature change of the coolant by heat radiation. The controller 100 calculates the temperature change of the coolant by heat radiation by reflecting the surface area of the diesel engine 10 and the heat conductivity of the cylinder block 40 and the cylinder head 30.

The controller 100 calculates a temperature increase of the coolant per unit time from the balance of the calculated temperature change due to the heat reception and the calculated temperature change due to the heat radiation. The controller 100 then adds the calculated temperature increase to the previous estimated liquid temperature ethwest, thus updating the estimated liquid temperature ethwest.

When the estimated liquid temperature ethwest is equal to or higher than a predetermined liquid temperature 5, the controller 100 terminates the circulation stop control. The predetermined liquid temperature δ is a temperature at which it is possible to determine that the cylinder block 40 and the cylinder head 30 have been warmed up based on the fact that the estimated liquid temperature ethwest is equal to or higher than the predetermined liquid temperature δ. Moreover, the predetermined liquid temperature δ is lower than the boiling point of the coolant.

After terminating the circulation stop control, the controller 100 executes low flow rate control before executing the outlet liquid temperature feedback control. With the low flow rate control, the motor-driven pump 60 is slowly driven. The coolant is then circulated in the coolant circuit R10 at a low flow rate so as not to reduce the temperature of the cylinder block 40 and the cylinder head 30 warmed up by the circulation stop control. In the low flow rate control, the motor-driven pump 60 is driven with a drive amount less than that in the outlet liquid temperature feedback control. The coolant in the coolant circuit R10 is thus stirred little by little while being warmed up by heat generated in the diesel engine 10. Not only the temperature of the coolant in the water jackets 45 and 36 but also the temperature of the coolant in the coolant circuit R10 is gradually increased. The coolant is moved in the coolant circuit R10 during the low flow rate control, and thus it is possible to check the progress of the warm-up by the outlet liquid temperature ethwout detected by the outlet liquid temperature sensor 54. When the outlet liquid temperature ethwout is equal to or higher than the threshold α, the controller 100 determines that a uniform temperature of the coolant is achieved and then terminates the low flow rate control. The controller 100 then starts the outlet liquid temperature feedback control described above.

As described above, in the coolant circulation system, the controller 100 basically executes the circulation stop control when the outlet liquid temperature ethwout at the time of start-up of the internal combustion engine is equal to or lower than the threshold α, and preferentially warms up the cylinder block 40 and the cylinder head 30 through the circulation stop control. When the estimated liquid temperature ethwest is equal to or higher than the predetermined liquid temperature δ, the controller 100 executes the low flow rate control to achieve a uniform temperature of the coolant so as not to cool the cylinder block 40 and the cylinder head 30. When the temperature of the coolant is made uniform and the outlet liquid temperature ethwout is equal to or higher than the threshold α, the controller 100 determines that the warm-up has been completed, terminates the low flow rate control, and starts the outlet liquid temperature feedback control.

However, in the coolant circulation system, the execution of the circulation stop control or the low flow rate control is sometimes prohibited depending on the conditions. For example, when a sensor connected to the controller 100 is abnormal or when the diesel engine 10 is in a high-load operating state, the execution of the circulation stop control and the low flow rate control is prohibited. In addition, when the accumulated fuel injection amount since the start of the circulation stop control is equal to or greater than a termination determination value, the execution of the circulation stop control is prohibited and the low flow rate control is executed. The termination determination value is a threshold for determining whether the coolant is likely to boil. Based on the fact that the accumulated fuel injection amount is equal to or greater than the termination determination value, the controller 100 determines that the accumulated fuel injection amount has been increased to an extent that the amount of heat generated in the diesel engine 10 reaches the amount of generated heat required for boiling the coolant. The controller 100 sets the termination determination value such that the lower the initial liquid temperature, the greater the termination determination value becomes. The controller 100 calculates the accumulated fuel injection amount by accumulating the fuel injection amount Q during the circulation stop control. When the calculated accumulated fuel injection amount is equal to or greater than the termination determination value, the controller 100 terminates the circulation stop control.

As described above, the controller 100 calculates the estimated liquid temperature ethwest during the circulation stop control of the coolant circulation system. When the estimated liquid temperature ethwest is equal to or higher than the predetermined liquid temperature δ, the controller 100 terminates the circulation stop control. In this case, the controller 100 calculates the estimated liquid temperature ethwest by setting the initial liquid temperature to the outlet liquid temperature ethwout at the start of the circulation stop control. The controller 100 sets the period during which the circulation stop control is executed such that the lower the outlet liquid temperature ethwout at the start of the circulation stop control, the longer period becomes. That is, the controller 100 changes the period during which the circulation stop control is executed in accordance with the outlet liquid temperature ethwout detected by the outlet liquid temperature sensor 54 at the start of the circulation stop control.

When such a configuration is employed, the coolant may boil in the part of the internal combustion engine with a higher temperature of the coolant than that in the vicinity of the liquid temperature sensor. That is, while the circulation stop control is executed according to the temperature of the coolant at the start of the circulation stop control, the coolant may reach the boiling point in the part of the internal combustion engine with a higher temperature of the coolant than that in the vicinity of the liquid temperature sensor.

In the case of the coolant circulation system, the estimated liquid temperature ethwest is calculated by setting the initial liquid temperature to the outlet liquid temperature ethwout at the start of the circulation stop control as described above. For this reason, when the temperature of the coolant in the exhaust air cooling portion 36*a* at the start of the circulation stop control deviates largely from the outlet liquid temperature ethwout, the estimated liquid temperature ethwest easily deviates from the temperature of the coolant in the exhaust air cooling portion 36*a*. For example, there is a large variation in the temperature of the coolant in the water jackets 45 and 36 and thus the temperature of the coolant in the exhaust air cooling portion 36*a* at the start of the circulation stop control is sometimes higher than the outlet liquid temperature ethwout. In such a case, the coolant may boil in the exhaust air cooling portion 36*a* before the estimated liquid temperature ethwest reaches the predetermined liquid temperature δ.

Thus, the coolant circulation system executes variation determination control for determining the variation in the temperature of the coolant at the time of start-up of the internal combustion engine. In the variation determination control, it is determined whether the variation in the temperature of the coolant in the diesel engine 10 is equal to or less than a predetermined value. The circulation stop control is executed on condition that the variation in the temperature of the coolant is equal to or less than the predetermined value.

Next, a series of processes of the variation determination control is described with reference to FIG. 3. This series of processes is performed by the controller 100 when the diesel engine 10 starts up. While performing the series of processes, the controller 100 repeatedly obtains the outlet liquid temperature ethwout at a predetermined cycle.

Figure 3:
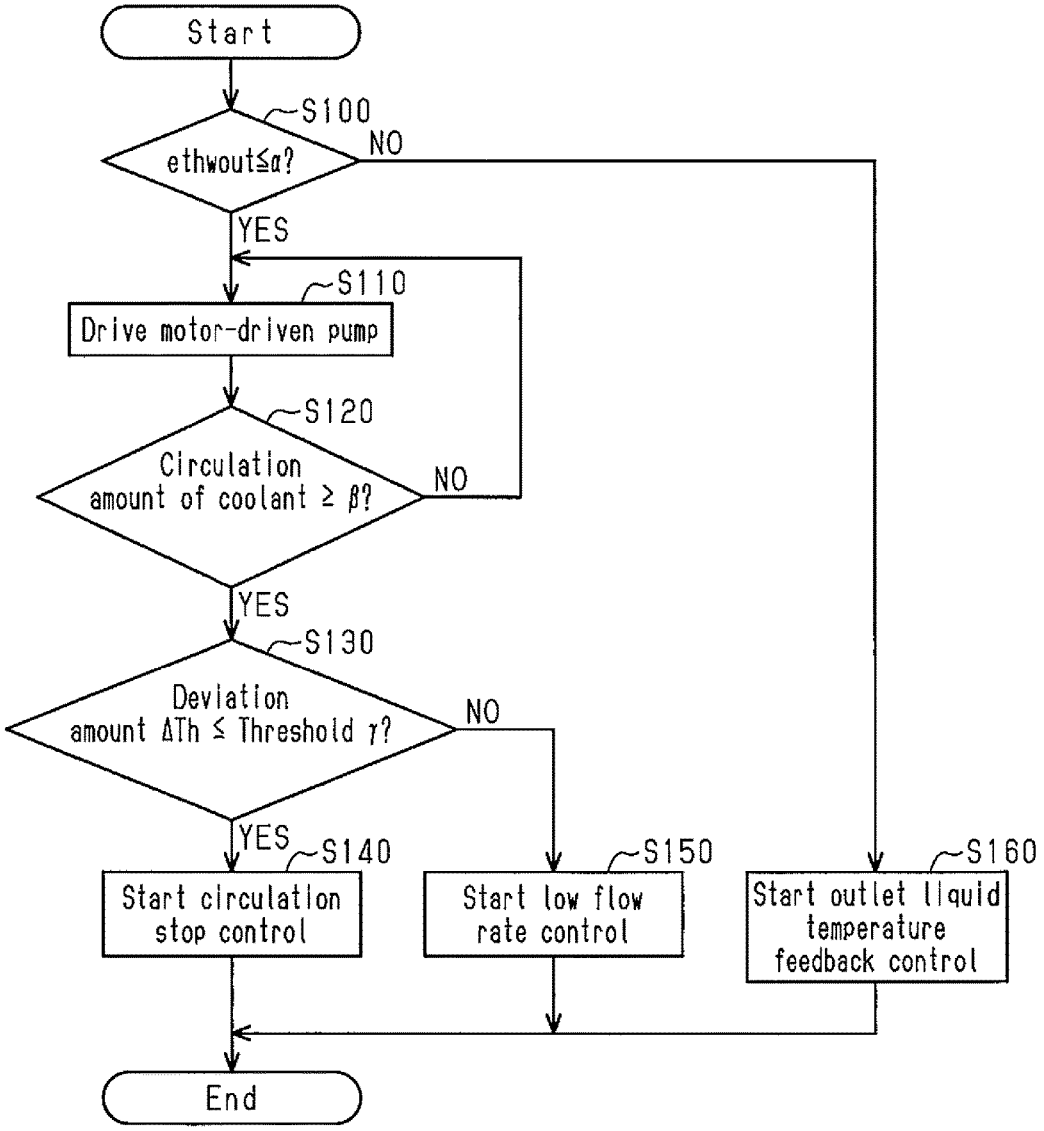
FIG. 3 is a flowchart of a series of processes of variation determination control in the coolant circulation system.

As shown in FIG. 3, when the series of processes starts, the controller 100 determines at step S100 whether the outlet liquid temperature ethwout is equal to or lower than the threshold α. If it is determined that the outlet liquid temperature ethwout is equal to or lower than the threshold α (YES at step S100), the controller 100 proceeds process to step S110.

At step S110, the controller 100 drives the motor-driven pump 60. The controller 100 drives the motor-driven pump 60 at a lower drive duty cycle than that in the low flow rate control. Next, the controller 100 determines at step S120 whether the circulation amount of the coolant since the drive of the motor-driven pump 60 starts is equal to or greater than a threshold β. The threshold β, is set to be the circulation amount before the coolant in the exhaust air cooling portion 36*a* is moved to the outlet liquid temperature sensor 54. That is, the circulation amount is based on the capacity of the part of the coolant circuit R10 from the exhaust air cooling portion 36*a* to the outlet liquid temperature sensor 54. The controller 100 determines whether the circulation amount of the coolant is equal to or greater than the threshold β based on the drive time since the drive of the motor-driven pump 60 starts.

If it is determined that the circulation amount of the coolant since the drive of the motor-driven pump 60 starts is less than the threshold β (NO at step S120), the controller 100 returns the process to step S110. If it is determined that the circulation amount of the coolant since the drive of the motor-driven pump 60 starts is equal to or greater than the threshold β (YES at step S120), the controller 100 proceeds to step S130. That is, the controller 100 continues to drive the motor-driven pump 60 until the circulation amount of the coolant since the drive of the motor-driven pump 60 starts is equal to or greater than the threshold β. The motor-driven pump 60 is thus driven during the period in which the coolant that is present in the exhaust air cooling portion 36*a* at the time of start-up of the internal combustion engine reaches the outlet liquid temperature sensor 54.

At step S130, the controller 100 determines whether the deviation amount ΔTh of the outlet liquid temperature ethwout obtained immediately before the drive of the motor-driven pump 60 starts from the maximum value, which is the highest temperature of the outlet liquid temperatures ethwout obtained while the motor-driven pump 60 is driven, is equal to or less than a threshold γ. Specifically, the controller 100 calculates, as the deviation amount ΔTh, the absolute value of the difference between the maximum value, which is the highest temperature of outlet liquid temperatures ethwout obtained while the motor-driven pump 60 is driven, and the outlet liquid temperature ethwout obtained immediately before the drive of the motor-driven pump 60 starts. The controller 100 then compares the deviation amount ΔTh to the threshold γ.

The threshold γ is used to determining whether the execution of the circulation stop control is permitted. Based on the fact that the deviation amount ΔTh is equal to or less than the threshold γ, it is possible to determine that the variation in the temperature of the coolant in the diesel engine 10 is within the range that allows the estimated liquid temperature ethwest to be calculated with an adequate accuracy for executing the circulation stop control.

If it is determined that the deviation amount ΔTh is equal to or less than the threshold γ (YES at step S130), the controller 100 proceeds to step S140 and starts the circulation stop control. If it is determined that the deviation amount ΔTh is greater than the threshold γ (NO at step S130), the controller 100 proceeds to step S150 and starts the low flow rate control without executing the circulation stop control.

Meanwhile, if it is determined that the outlet liquid temperature ethwout is higher than the threshold α (NO at step S100), the controller 100 proceeds to step S160 and starts outlet liquid temperature feedback control without executing the circulation stop control and the low flow rate control. The controller 100 performs the process at step S140, step S150, or step S160 and then terminates the series of processes.

The processes at steps S110 to S130 correspond to the variation determination control in the coolant circulation system. That is, the controller 100 drives the motor-driven pump 60 in a predetermined period at the time of cold-start of the internal combustion engine to move the coolant in the coolant circuit R10. The controller 100 thus executes the variation determination control for determining whether a variation in the temperature of the coolant in the diesel engine 10 is equal to or less than the predetermined value based on the outlet liquid temperature ethwout. If the variation in the temperature of the coolant is equal to or less than the predetermined value, the controller 100 executes the circulation stop control.

Figure 4:
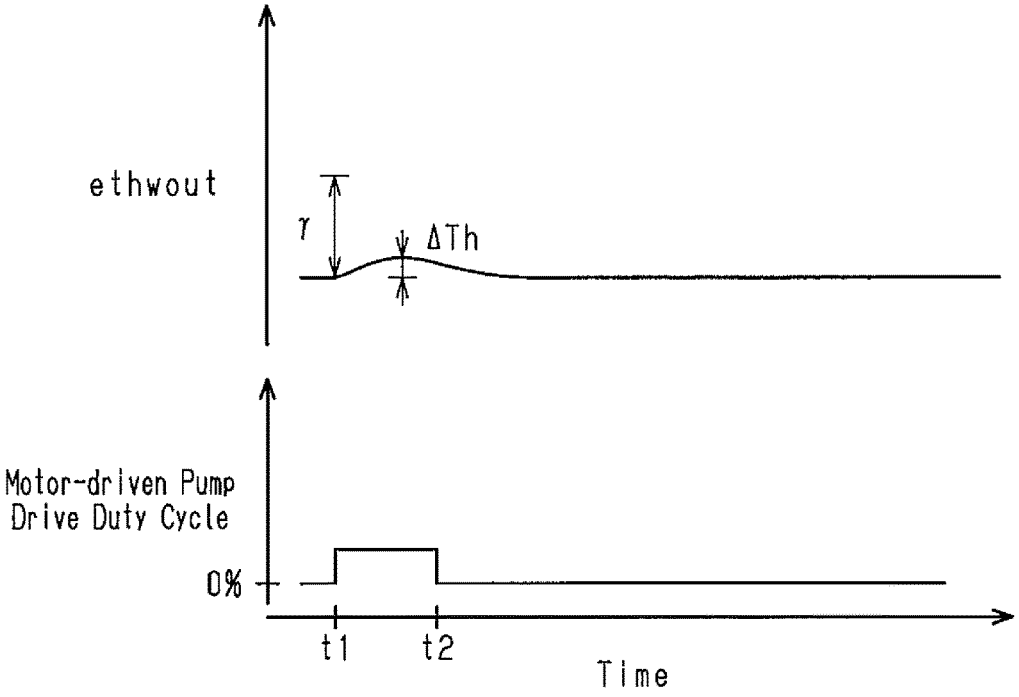
FIG. 4 is a timing diagram of the relationship between movement of a drive duty cycle of a motor-driven pump and movement of an outlet liquid temperature in a case in which the variation in the temperature of the coolant is small.
Figure 5:
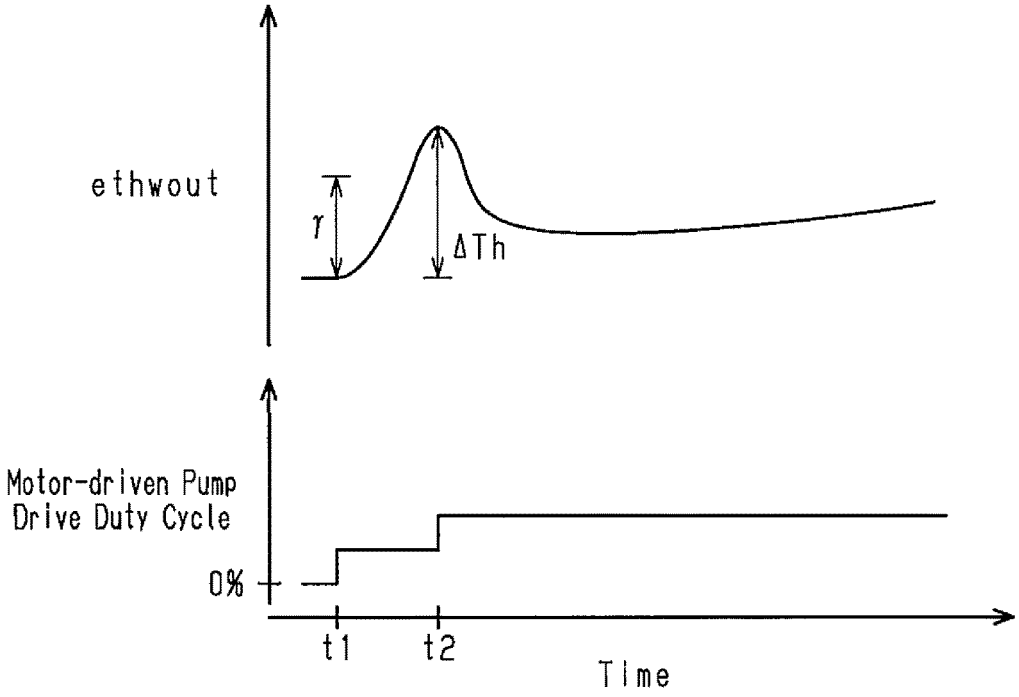
FIG. 5 is a timing diagram of the relationship between movement of the drive duty cycle of the motor-driven pump and movement of the outlet liquid temperature in a case in which the variation in the temperature of the coolant is large.

Next, an operation of the variation determination control is described with reference to FIGS. 4 and 5. FIGS. 4 and 5 are timing diagrams of the relationship between the movement of the drive duty cycle of the motor-driven pump 60 when the outlet liquid temperature ethwout at the time of start-up of the internal combustion engine is equal to or lower than the threshold α and the movement of the outlet liquid temperature ethwout. FIG. 4 shows the case in which the variation in the temperature of the coolant in the diesel engine 10 is small. FIG. 5 shows the case in which the variation in the temperature of the coolant in the diesel engine 10 is large.

The case in which the variation in the temperature of the coolant is small is described first with reference to FIG. 4. When the diesel engine 10 starts up at time t1, the variation determination control starts. The motor-driven pump 60 is driven at an extremely low drive duty cycle and the coolant in the coolant circuit R10 starts to be moved. The outlet liquid temperature ethwout detected by the outlet liquid temperature sensor 54 is also changed. While executing the variation determination control and driving the motor-driven pump 60, the controller 100 continues to obtain the outlet liquid temperature ethwout. When the circulation amount of the coolant since the drive of the motor-driven pump 60 starts is equal to or greater than the threshold β at time t2, the controller 100 determines whether the deviation amount ΔTh of the outlet liquid temperature ethwout obtained immediately before the drive of the motor-driven pump 60 starts from the maximum value of the outlet liquid temperatures ethwout obtained during the drive of the motor-driven pump 60 is equal to or less than the threshold γ. In the example of FIG. 4, the deviation amount ΔTh is equal to or less than the threshold γ, and thus the circulation stop control starts and the drive of the motor-driven pump 60 is stopped after the time t2 (the drive duty cycle is set to be 0%).

Next, the case in which the variation in the temperature of the coolant is large is described with reference to FIG. 5. When the variation determination control starts at the time t1, the outlet liquid temperature ethwout detected by the outlet liquid temperature sensor 54 starts to change. In this case, the variation in the temperature of the coolant in the diesel engine 10 is large and thus the outlet liquid temperature ethwout changes more than that of the example of FIG. 4. The controller 100 determines at the time t2 whether the deviation amount ΔTh is equal to or less than the threshold γ, as in the example of FIG. 4. The deviation amount ΔTh is greater than the threshold γ in the example of FIG. 5 and thus the circulation stop control is not executed and the low flow rate control is instead executed after the time t2. After the time t2, the motor-driven pump 60 is driven at a higher drive duty cycle than that when the variation determination control is executed.

The above-described embodiment achieves the following advantages.

(1) When the variation in the temperature of the coolant in the diesel engine 10 is large, that is, when the outlet liquid temperature ethwout detected by the outlet liquid temperature sensor 54 is likely to be inappropriate for starting circulation stop control, the circulation stop control is not executed. It is thus possible to prevent the coolant from boiling.

(2) To prevent the coolant from boiling even when the temperature of the coolant in the diesel engine 10 is not uniform, for example, the predetermined temperature δ may be set to be much lower and the circulation stop control may be terminated at a much lower temperature. However, in this case, the circulation stop control is terminated before the warm-up is sufficiently performed, and thus the effect of promoting the warm-up by the circulation stop control is degraded.

In the embodiment described above, the circulation stop control is executed only when the variation in the temperature of the coolant in the diesel engine 10 is small and the circulation stop control can be adequately executed according to the outlet liquid temperature ethwout detected by the outlet liquid temperature sensor 54 at the start of the circulation stop control. Thus, it is possible to extend the period during which the circulation stop control is executed as compared to the case in which the circulation stop control is terminated at a lower temperature, as described above. It is thus possible to effectively promote the warm-up by the circulation stop control.

(3) With the advantages (1) and (2) described above, it is possible to prevent the coolant from boiling and at the same time, to effectively promote the warm-up.

(4) To adequately estimate the variation in the temperature of the coolant in the internal combustion engine in variation determination control, it is preferable to detect the temperature of the coolant in the part with a high temperature and the temperature of the coolant in the part with a low temperature. Regarding this point, the exhaust air cooling portion 36*a* is close to the combustion chamber 14 and cools the exhaust port exposed to high-temperature exhaust air. For this reason, the temperature of the coolant near the exhaust air cooling portion 36*a* tends to be particularly increased. Meanwhile, the outlet of the coolant is disposed on the surface of the diesel engine 10 cooled by outside air. For this reason, in the coolant of the diesel engine 10, the coolant near the outlet in particular tends to have a low temperature while the internal combustion engine stops.

In the coolant circulation system, the temperature of the coolant in the part with a low temperature is detected first by the outlet liquid temperature sensor 54 in the variation determination control. The motor-driven pump 60 is then driven until the temperature of the coolant that is present in the exhaust air cooling portion 36*a* at the time of start-up of the internal combustion engine is detected by the outlet liquid temperature sensor 54. Thus, it is possible to estimate the variation in the temperature of the coolant by detecting the temperature of the coolant in the exhaust air cooling portion 36*a* and the temperature of the coolant at the outlet, without driving the motor-driven pump 60 until all the coolant in the diesel engine 10 passes through the outlet liquid temperature sensor 54.

That is, it is possible to quickly terminate the variation determination control and proceed to the circulation stop control as compared to the case in which the motor-driven pump 60 is driven until all the coolant in the diesel engine 10 passes through the outlet liquid temperature sensor 54. Consequently, the effect of promoting the warm-up is not degraded by the movement of the coolant caused by the variation determination control.

(5) At the time point when the motor-driven pump 60 is driven until the coolant in the exhaust air cooling portion 36*a* reaches the outlet liquid temperature sensor 54, it is possible to determine the variation in the temperature of the coolant by using the maximum value of the temperature of the coolant detected during the drive of the motor-driven pump 60. It is thus possible to determine the variation in the temperature of the coolant by reflecting information about the temperature of the coolant detected during the drive of the motor-driven pump 60 as much as possible.

(6) In the case in which the variation in the temperature of the coolant is determined at the time point when the motor-driven pump 60 is driven until the coolant in the exhaust air cooling portion 36*a* reaches the outlet liquid temperature sensor 54, when it is determined that the variation in the temperature of the coolant is small (YES at step S130), the coolant in the exhaust air cooling portion 36*a* in which the temperature of the coolant is particularly high in the diesel engine 10 has been moved to the outlet liquid temperature sensor 54. For this reason, the outlet liquid temperature ethwout that is detected when the circulation stop control starts on condition that the variation in the temperature of the coolant is small approximates the temperature of the exhaust air cooling portion 36*a,* which is easily increased particularly during the operation of the engine. In addition, in this cooling system, the estimated liquid temperature ethwest is calculated by setting the initial liquid temperature to the temperature detected at the start of the circulation stop control. It is thus possible to adequately estimate the temperature of the coolant in the exhaust air cooling portion 36*a,* which is easily increased in particular. As the circulation stop control is terminated based on the calculated estimated liquid temperature ethwest, it is possible to execute the circulation stop control as long as possible within the range that prevents the coolant from boiling.

(7) The accumulated fuel injection amount is correlated with the total amount of heat generated in the internal combustion engine during the circulation stop control. It is thus possible to estimate the progress of the warm-up and the possibility of boiling by the accumulated fuel injection amount. Regarding this point, if the accumulated fuel injection amount during the circulation stop control is equal to or greater than the termination determination value, the coolant circulation system prohibits the execution of the circulation stop control, temporarily stops the circulation stop control, and executes the low flow rate control. It is thus possible to determine that boiling is likely to occur by using the accumulated fuel injection amount and then to terminate the circulation stop control.

(8) It is preferable to execute liquid temperature feedback control after the warm-up for the purpose of preventing overheating of the diesel engine 10. However, when the motor-driven pump 60 is driven after the circulation stop control to start circulation of the coolant, if the process immediately proceeds to the liquid temperature feedback control, the coolant that has not been warmed up flows into the water jackets 45 and 36 of the diesel engine 10 and cools the diesel engine 10 warmed up during the circulation stop control. It is thus preferable to execute the low flow rate control for driving the motor-driven pump 60 with a drive amount less than that in the liquid temperature feedback control after the circulation stop control, thus circulating the coolant little by little so as not to cool the diesel engine 10. Regarding this point, after the circulation stop control is terminated, the low flow rate control is executed before the outlet liquid temperature feedback control is executed in the present embodiment. It is thus possible to prevent the diesel engine 10 from being cooled as the process proceeds to the outlet liquid temperature feedback control.

(9) In the variation determination control, to determine the variation in the temperature of the coolant in the internal combustion engine, the motor-driven pump 60 is driven to move the coolant and then the temperature of the coolant is detected. At this time, if the drive amount of the motor-driven pump 60 is too large, the coolant is stirred and thus the variation in the temperature of the coolant cannot be determined accurately. Regarding this point, according to the present embodiment, the motor-driven pump 60 is driven with a drive amount much less than that in the low flow rate control in the variation determination control. It is thus possible to prevent the coolant from being stirred by the drive of the motor-driven pump 60. As a result, it is possible to determine the variation in the temperature of the coolant more accurately.

The above-described embodiment may be modified as follows.

While the coolant circulation system for the diesel engine 10 has been exemplified, the internal combustion engine to which a configuration similar to the present invention may be applied is not limited to a diesel engine. For example, the present invention may be applied to a coolant circulation system for cooling a gasoline engine.

The drive duty cycle of the motor-driven pump 60 in the variation determination control does not need to be lower than the drive duty cycle of the motor-driven pump 60 in the low flow rate control. However, to prevent a coolant from being stirred by the drive of the motor-driven pump 60 and determine a variation in the coolant more accurately, it is preferable to set the drive amount of the motor-driven pump 60 as small as possible in the variation determination control.

The liquid temperature sensor is not limited to the outlet liquid temperature sensor. That is, the liquid temperature sensor that detects the temperature of the coolant does not need to be disposed at the outlet of the coolant from the internal combustion engine. For example, the liquid temperature sensor may be disposed at the entrance of the coolant to the internal combustion engine. In this case, however, to determine the variation in the temperature of the coolant in the internal combustion engine by using the temperature of the coolant detected by the liquid temperature sensor, it is necessary to drive the motor-driven pump 60 until the coolant is circulated in the coolant circuit R10 in the variation determination control. In this case, the coolant tends to be stirred before the coolant in the internal combustion engine reaches the liquid temperature sensor. As a result, it is impossible to accurately determine a variation in the temperature of the coolant. It is thus preferable to dispose the liquid temperature sensor near the outlet of the coolant from the internal combustion engine.

A method of calculating an increase in the temperature of the coolant in calculating the estimated liquid temperature ethwest may be changed as necessary. For example, other parameters correlated with the amount of heat received and the amount of heat radiated may be added to the parameters used to calculate the temperature increase.

The liquid temperature that is estimated as the estimated liquid temperature ethwest does not need to be the liquid temperature of the coolant in the exhaust air cooling portion 36*a*. However, to prevent boiling, it is preferable to estimate the temperature of the coolant in the part of the internal combustion engine in which the temperature tends to be increased.

The same problem as in the present invention may occur when the period during which the circulation stop control is executed is changed in accordance with the temperature of the coolant detected by a liquid temperature sensor at the start of the circulation stop control. The conditions for terminating the circulation stop control can thus be changed as necessary. For example, the circulation stop control is also terminated when the accumulated fuel injection amount during the circulation stop control is equal to or greater than the termination determination value in the embodiment described above, and thus calculation of the estimated liquid temperature ethwest may be omitted. Also in this case, the lower the initial liquid temperature is, the greater the termination determination value is set. The period during which the circulation stop control is executed is thus changed in accordance with the temperature of the coolant detected by a liquid temperature sensor at the start of the circulation stop control. Similar advantages to those of the embodiment described above are obtained if the circulation stop control is executed when it is determined by the variation determination control that the variation in the temperature of the coolant is small.

Similarly to the accumulated fuel injection amount, an accumulated intake air amount during the circulation stop control may be an index of the total amount of heat generated in the internal combustion engine during the circulation stop control. Thus, the fact that the intake air amount during the circulation stop control is equal to or greater than the termination determination value may be set as the condition for terminating the circulation stop control. In addition, if the accumulated stop time of the motor-driven pump 60 during the circulation stop control is long, it is possible to estimate that the warm-up is accelerated. Consequently, the fact that the accumulated stop time is equal to or greater than the termination determination value may be set as the condition for terminating the circulation stop control. In both cases, if the termination determination value is set such that the lower the initial liquid temperature, the greater the termination determination value is, when it is determined in the variation determination control that the variation is small, the circulation stop control is executed. As a result, advantages similar to those of the embodiment described above are obtained. Alternatively, the termination determination value may be set by combining these termination conditions as in the embodiment described above.

In the variation determination control, whether the variation in the temperature of the coolant is equal to or less than the predetermined value is determined depending on whether the deviation amount $\Delta Th$ of the outlet liquid temperature ethwout detected immediately before the drive of the motor-driven pump 60 starts from the maximum value of the outlet liquid temperature ethwout detected during the drive of the motor-driven pump 60 is equal to or less than the threshold $\delta$. The method of calculating the deviation amount used for determination may be adequately changed. For example, instead of the outlet liquid temperature ethwout that is detected immediately before the drive of the motor-driven pump 60 starts, the outlet liquid temperature ethwout detected at the start of the drive of the motor-driven pump 60 and the outlet liquid temperature ethwout detected immediately after the drive of the motor-driven pump 60 starts may be used. Alternatively, instead of the maximum value of the outlet liquid temperature ethwout detected during the drive of the motor-driven pump 60, the outlet liquid temperature ethwout when the drive of the motor-driven pump 60 is stopped and the outlet liquid temperature ethwout immediately after the drive of the motor-driven pump 60 is stopped may be used.

The method of determining whether the variation in the temperature of the coolant is equal to or less than the predetermined value may be adequately changed. For example, whether the variation is equal to or less than the predetermined value may be determined based on the deviation amount between the maximum value and the minimum value that are obtained during the variation determination control. Alternatively, the deviation amount does not need to be used to determine the variation. For example, whether the variation is equal to or less than the predetermined value may be determined based on the standard variation of the temperature of the coolant that is obtained during the variation determination control.

The invention claimed is:

1. A coolant circulation system for a vehicle-mounted internal combustion engine, the system comprising:

a coolant circuit including a water jacket of an internal combustion engine;

a motor-driven pump, which is provided in a middle of the coolant circuit and moves coolant in the coolant circuit;

a liquid temperature sensor, which detects a temperature of the coolant flowing in the coolant circuit; and a controller, which controls the motor-driven pump, wherein the controller executes circulation stop control in which the motor-driven pump is not driven so that circulation of the coolant is kept stopped after the internal combustion engine starts up, the controller changes a period during which the circulation stop control is executed in accordance with a temperature the coolant detected by the liquid temperature sensor at the start of the circulation stop control, the controller executes variation determination control in which the motor-driven pump is driven during a predetermined period after the internal combustion engine starts up to move the coolant in the coolant circuit, thereby determining whether a variation in a temperature of the coolant in the internal combustion engine is equal to or less than a predetermined value based on the temperature of the coolant detected by the liquid temperature sensor, and the controller executes the circulation stop control on condition that it is determined in the variation determination control that the variation in the temperature of the coolant is equal to or less than the predetermined value.

2. The coolant circulation system for a vehicle-mounted internal combustion engine according to claim 1, wherein the liquid temperature sensor is an outlet liquid temperature sensor, which detects a temperature of the coolant at an outlet of the coolant from the internal combustion engine, and the predetermined period is a period from when drive of the motor-driven pump is started after the internal combustion engine starts up to when the coolant that is present in a part of the water jacket that cools an exhaust port of the internal combustion engine reaches the outlet liquid temperature sensor.

3. The coolant circulation system for a vehicle-mounted internal combustion engine according to claim 2, wherein in the variation determination control, the controller determines whether the variation in the temperature of the coolant in the internal combustion engine is equal to or less than the predetermined value depending on whether a deviation amount of the temperature of the coolant detected by the outlet liquid temperature sensor immediately before the drive of the motor-driven pump is started from a maximum value of the temperature of the coolant detected by the outlet liquid temperature sensor during the drive of the motor-driven pump is equal to or less than a predetermined value, and if the deviation amount during the drive of the motor-driven pump is equal to or less than the predetermined value, the controller determines that the variation in the temperature of the coolant is equal to or less than the predetermined value.

4. The coolant circulation system for a vehicle-mounted internal combustion engine according to claim 3, wherein when starting the circulation stop control, the controller sets, to the temperature of the coolant detected by the liquid temperature sensor, an initial liquid temperature of an estimated liquid temperature, which is an estimated value of the temperature of the coolant in the part of the water jacket that cools the exhaust port of the internal combustion engine, the controller accumulates a temperature increase of the coolant in the part of the water jacket that cools the exhaust port of the internal combustion engine during the circulation stop control to calculate the estimated liquid temperature, and the controller terminates the circulation stop control when the estimated liquid temperature calculated is equal to or greater than the predetermined liquid temperature.

5. The coolant circulation system for a vehicle-mounted internal combustion engine according to claim 4, wherein the controller obtains an engine rotational speed, a fuel injection amount, a forced-induction pressure, an EGR rate, a vehicle speed, and an outside air temperature and calculates the temperature increase of the coolant.

6. The coolant circulation system for a vehicle-mounted internal combustion engine according to claim 3, wherein the controller determines a termination determination value such that the lower the temperature of the coolant detected by the liquid temperature sensor at the start of the circulation stop control, the greater the termination determination value becomes, the controller accumulates a fuel injection amount during the circulation stop control to calculate an accumulated fuel injection amount, and the controller terminates the circulation stop control when the accumulated fuel injection amount calculated is equal to or greater than the termination determination value.

7. The coolant circulation system for a vehicle-mounted internal combustion engine according to claim 1, wherein, in addition to the variation determination control and the circulation stop control, the controller executes liquid temperature feedback control for feedback-controlling a drive amount per unit time of the motor-driven pump in accordance with the temperature of the coolant detected by the liquid temperature sensor and minute flow rate control for driving the motor-driven pump with a drive amount less than that in the liquid temperature feedback control.

8. The coolant circulation system for a vehicle-mounted internal combustion engine according to claim 7, wherein, in the variation determination control, the controller drives the motor-driven pump with a drive amount less than that in the minute rate control.

* * * * *